US005730004A

United States Patent [19]

Voit

[11] Patent Number: 5,730,004

[45] Date of Patent: Mar. 24, 1998

[54] TRIPLE-COLUMN FOR THE LOW-TEMPERATURE SEPARATION OF AIR

[75] Inventor: Jürgen Voit, Schondorf, Germany

[73] Assignee: Linde Aktiengesellschaft, Wiesbaden, Germany

[21] Appl. No.: 728,371

[22] Filed: Oct. 10, 1996

[30] Foreign Application Priority Data

Oct. 11, 1995 [DE] Germany ..... 195 37 913.6

[51] Int. Cl.[6] ..... F25J 3/04

[52] U.S. Cl. ..... 62/646; 62/900; 62/939

[58] Field of Search ..... 62/646, 900, 939

[56] References Cited

U.S. PATENT DOCUMENTS

| | | | |
|---|---|---|---|
| 4,356,013 | 10/1982 | Linde et al. | 62/646 |
| 5,069,699 | 12/1991 | Agrawal | 62/646 |
| 5,233,838 | 8/1993 | Howard | 62/646 |
| 5,331,818 | 7/1994 | Rathbone | 62/646 |
| 5,341,646 | 8/1994 | Agrawal et al. | 62/646 |
| 5,386,692 | 2/1995 | LaForce | 62/646 |
| 5,471,843 | 12/1995 | Chretien | 62/646 |
| 5,485,729 | 1/1996 | Higgenbotham | 62/646 |
| 5,582,031 | 12/1996 | Rathbone | 62/646 |

*Primary Examiner*—Christopher Kilner

*Attorney, Agent, or Firm*—Millen, White, Zelano, & Branigan, P.C.

[57] ABSTRACT

The process and apparatus are based on a triple-column system, having at least a high-pressure column (7), a medium-pressure column (8) and a low-pressure column (9). Feed air (1) is compressed to a first pressure (2). A first partial stream (101, 103, 104) of the resultant air feed (3) is sent into high-pressure column (7) after it has been compressed to a second pressure (5, 102), which is at least equal to the operating pressure of the high-pressure column (7). A second partial stream (201, 202) of the compressed air feed (3) is fed into the medium-pressure column (8). A third partial stream (301, 303, 304) of the compressed air feed (3) is engine-expanded (305) and then fed (306) into the low-pressure column (9). Fractions (18; 26) from the high-pressure column (7) and the medium-pressure column (8) are introduced at least partially into low-pressure column (19, 20; 28, 29). Nitrogen-enriched top fractions (10; 21) from high-pressure column (7) and medium-pressure column (8) are condensed (11; 22). Resultant condensate (13; 24) is fed (15, 16; 25) into low-pressure column (9) as reflux. The first pressure is thus lower than the operating pressure of medium-pressure column (8), thus the second partial stream of the air feed is compressed from the first pressure to a third pressure (5), which is at least equal to the operating pressure of the medium-pressure column (8), but lower than the second pressure.

14 Claims, 1 Drawing Sheet

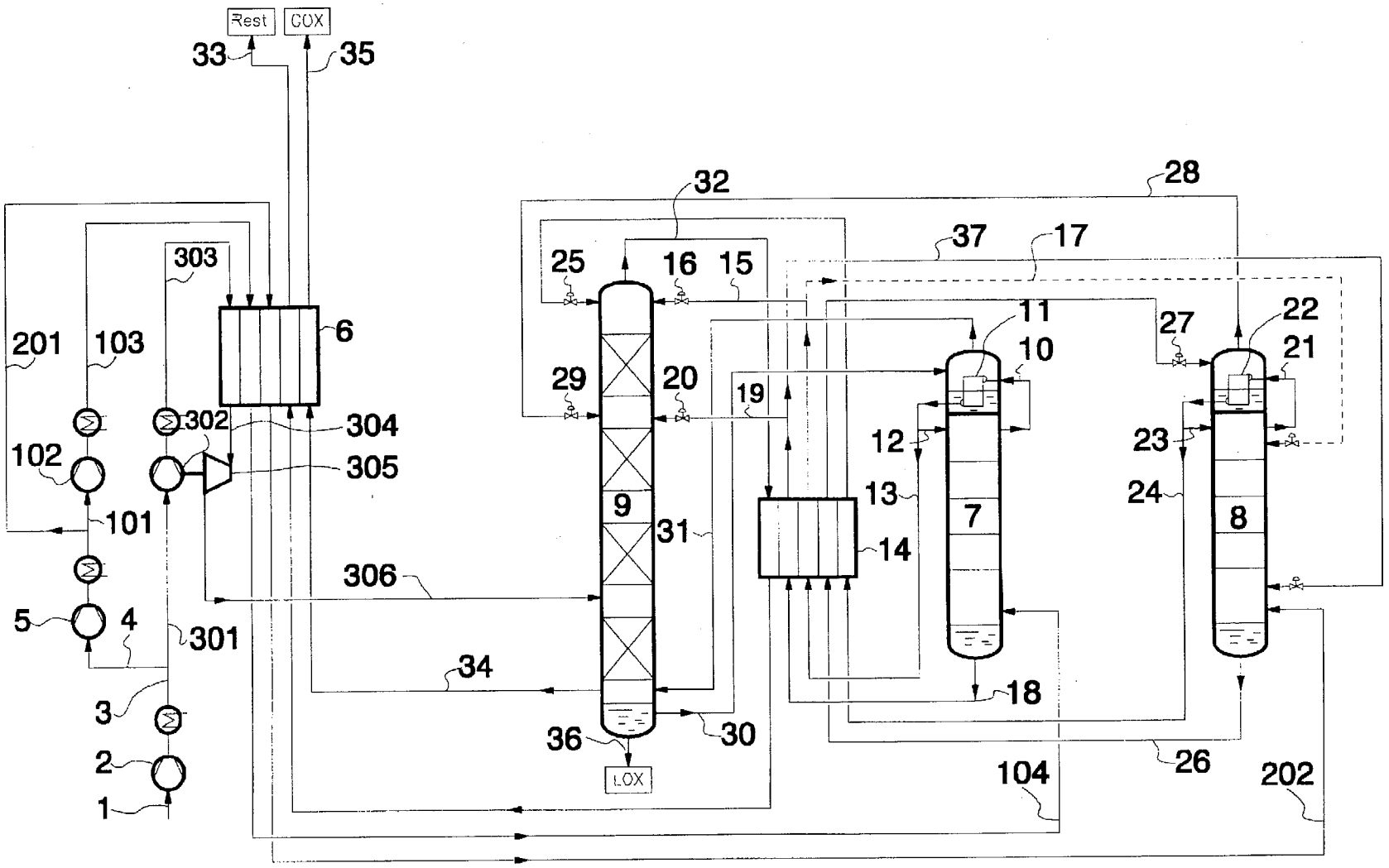
COX
Rest
LOX

TRIPLE-COLUMN FOR THE LOW-TEMPERATURE SEPARATION OF AIR

BACKGROUND OF THE INVENTION

This invention relates to a process and apparatus for the low-temperature separation of air in a triple-column system which is comprised of a high-pressure column, a medium-pressure column and a low-pressure column.

A triple-column system has at least three columns for nitrogen-oxygen separation and may include systems and processes that have additional columns for nitrogen-oxygen separation and/or for extracting other air components, such as noble gases, for example, a crude argon column. A triple-column process of the above-mentioned type is known from the assignee's patent DE-A-2903089 corresponding to U.S. Pat. No. 4,356,013. In the known process, the entire volume of the air feed is compressed to a first pressure which exceeds that of the medium-pressure column pressure by a few tenths of a bar, and one partial stream thereof, after traversing a heat exchanger and a switching valve is fed directly into the medium-pressure column, while the other partial stream is further compressed to a second pressure and introduced into the high-pressure column. The remainder of the compressed air is engine-expanded and introduced into the low-pressure column.

SUMMARY OF THE INVENTION

An object of the invention is to provide an improved process of the above mentioned type having an especially high efficiency.

Another object is to provide apparatus for the improved process.

Upon further study of the specification and appended claims, further objects and advantages of this invention will become apparent to those skilled in the art.

To attain the process object of the invention, there is provided a process for the low-temperature separation of air in a triple-column system, comprising a high-pressure column, a medium-pressure column and a low-pressure column, comprising the following steps:

a) compression of air feed to a first pressure;

b) introduction of a first partial stream of compressed air feed into the high-pressure column, after the first partial stream of the air feed is compressed from the first pressure to a second pressure which is at least equal to the operating pressure of high-pressure column;

c) introduction of a second partial stream of compressed air feed into the medium-pressure column;

d) engine-expansion of a third partial stream of the compressed air feed;

e) introduction of the resultant engine-expanded air feed into the low-pressure column;

f) introduction of at least part stream of a first oxygen-enriched bottom fraction from the high-pressure column into the low-pressure column;

g) condensation of a first nitrogen-enriched top fraction from high-pressure column and introduction of the resultant condensate into the low-pressure column as reflux;

h) introduction of at least part of a second oxygen-enriched bottom fraction from the medium-pressure column into the low-pressure column;

i) condensation of a second nitrogen-enriched top fraction from the medium-pressure column and introduction of the resultant condensate into the low-pressure column as reflux, said process characterized in that j) the first pressure is lower than the operating pressure of the medium-pressure column, and k) the second partial stream of the air feed is compressed from the first pressure to a third pressure, which is at least equal to the operating pressure of the medium-pressure column, but lower than the second pressure.

Thus, as compared to the known process in the present process, the first pressure is lower, not higher, than the operating pressure of the medium-pressure column and the second partial stream of the air feed is compressed from the first pressure to a third pressure, which is at least equal to the operating pressure of the medium-pressure column, but is lower than the second pressure.

Consequently, compared to the known process, the total volume of air feed is compressed to only a relatively low pressure, which is below the pressure that prevails in the medium-pressure column. The second partial stream of air that is to be introduced into the medium-pressure column must be compressed further in another compressor, e.g., by a pressure differential of 1.4 to 2.4 bar. Conversely, the partial stream of air feed that is fed directly to the bottom part of the low-pressure column does not need to be brought to the high pressure of the high-pressure column. This is especially true if the refrigeration requirement of the system is relatively low, for example, in those cases where the products are all gaseous, or when only a fraction of the products is obtained in the liquid state, thus resulting in an especially low energy consumption.

Accordingly, it is advantageous if the third partial stream of the air feed is further compressed upstream from the engine-expansion to increase the pressure differential in the engine-expansion. Upon entering engine-expansion, the pressure in this case is preferably between the first pressure and that of the medium-pressure column. In this case, the energy that is obtained during the engine-expansion of the third air partial stream or a part thereof should be used to further compress the third air partial stream. The secondary compressor is preferably driven exclusively by this internally produced mechanical energy, so that it does not require any external energy. The secondary compressor and engine-expansion are coupled by, for example, a common shaft.

In the process according to the invention, the high-pressure column can be operated at a relatively low pressure, preferably at 4.8 bar or less. As a result, the cost of compressing the air feed is especially low.

The low-pressure column is preferably operated at the lowest possible pressure. For example, the top product of the low-pressure column—optionally after passage through one or more heat exchangers—can be removed from the process at essentially atmospheric pressure. On the other hand, if this top product is used as a regenerating gas in a purification device (e.g., a molecular sieve system), the pressure of the low-pressure column must be sufficient to enable the operation of the purification device.

It is also advantageous if a partial stream, e.g., about 10 to 30% of the first oxygen-enriched bottom fraction from the high-pressure column is introduced into the medium-pressure column. As a result, the partial stream branched from the bottom product of the high-pressure column is further fractionated thereby enabling a larger amount of nitrogen-enriched fraction to be obtained at the top of the medium-pressure column, which nitrogen-enriched fraction is available in the low-pressure column as reflux liquid. This further improves the rectification in the low-pressure column.

The bottom fraction from the high-pressure column is preferably introduced at an intermediate point in the medium-pressure column, i.e., at a point which is at least a practical or theoretical plate above the bottom of the medium-pressure column and especially at least a practical or theoretical plate above the point where the second air partial stream is fed into the medium-pressure column.

For conducting the process of the invention, the apparatus object of the invention comprises an apparatus for the low-temperature separation of air having a high-pressure column, a medium-pressure column and a low-pressure column, comprising:

a) a main air compressor for compressing air feed to a first pressure, b) a first branched conduit, connected to the outlet of main air compressor and to the high-pressure column, whereby the first branched conduit is in communication with means for compressing air feed from a first pressure to a second pressure which is at least equal to the operating pressure of the high-pressure column c) a second branched conduit, connected to the outlet of main air compressor and to the medium-pressure column, d) a third branched conduit, connected to the outlet of the main air compressor and in communication with a engine-expansion machine to low-pressure column, and e) conduit for introducing liquid from the top of high-pressure column and from the top of the medium-pressure column into the low-pressure column, and for introducing bottom liquid from the high-pressure column and from the medium-pressure column into the low-pressure column, said system characterized by f) means for compressing air feed from the first pressure to a third pressure, which is at least equal to the operating pressure of medium-pressure column, said means comprising an intake connected to the outlet of main air compressor and an outlet connected to the second branched conduit line.

It is also preferred to provide a secondary compressor arranged in the third branched conduit downstream from the engine-expansion machine, and it is advantageous to transfer the energy from the engine-expansion machine to the secondary compressor, e.g., by a common shaft. It is still further preferred to provide conduit connecting the bottom of the high-pressure column to the medium pressure column.

With the process and apparatus according to the invention, pure nitrogen can also be produced if a conventional pure nitrogen rectification section is arranged at the top of the low-pressure column. Argon extraction is also possible if the low-pressure column is placed downstream from an argon rectification column in a conventional manner (see, for example, EP-B-377117). Other noble gases can likewise be produced in a conventional manner.

BRIEF DESCRIPTION OF THE DRAWING

The invention as well as other details of the invention are explained in more detail below based on a preferred embodiment that is schematically depicted in the FIGURE.

DETAILED DESCRIPTION OF THE DRAWING

Air feed 1 is compressed in a main air compressor 2 to a first pressure. Compressed air feed 3 is divided into a first partial stream 101, a second partial stream 201, and a third partial stream 301. In compressors 5 and 102, the first partial stream is brought to a second pressure, and the second partial stream is brought to a third pressure which is between the first and the second pressure. In this case, the first partial stream and the second partial stream are first compressed together (4) in compressor 5 to the third pressure, and then first partial stream 101 by itself is further compressed in compressor 102 to the second pressure. As an alternative, the first and second partial streams can also be compressed independently of one another.

If the refrigeration requirement of the system and/or the product purity are relatively high, unlike the embodiment illustrated in the drawing, the third partial stream, which is fed to the engine-expansion machine 305 (e.g., a turbine) or secondary compressor 302, can be branched downstream from one of the compressors 5 or 102. With the higher input pressure to the turbine, the refrigerating capacity can be increased and/or the amount of the air that is injected directly into the low-pressure column can be reduced.

The first partial stream 103, which is under the second pressure, and second partial stream 201, which is under the third pressure, are cooled in a main heat exchanger 6 by product streams and fed into high-pressure column 7 or into medium-pressure column 8 (104 or 202). High-pressure column 7 is operated under a pressure of 4.5 to 5.5 bar, preferably 4.6 to 4.8 bar, and medium-pressure column 8 is operated under a pressure of 2.5 to 3.5 bar, preferably 2.8 to 3.0 bar.

The first pressure (in line 3 behind main air compressor 2) is considerably lower than the high-pressure column pressure, the pressure differential being at least 2.5 bar, and preferably 3.0 to 3.2 bar. The second pressure is slightly above the high-pressure column pressure (for example, about 0.1 bar above the pressure at the feed point into the high-pressure column) to offset the pressure drop in main heat exchanger 6 and in lines 103 and 104. Analogously, the third pressure (downstream from compressor 5) is somewhat greater than the pressure of the medium-pressure column to ensure the introduction of second partial stream 201, 202 into the medium-pressure column 8.

The third partial stream 301 is further compressed in a secondary compressor 302 to a fourth pressure, which can be between the first pressure and the operating pressure of the medium-pressure column and is, for example, 1.5 to 2.5 bar higher than the first pressure. (If the third partial stream is branched downstream from one of compressors 5 or 102, the fourth pressure is correspondingly higher, for example, higher than the pressure of the medium-pressure column or even higher than the pressure of the high-pressure column up to 8 bar or more). The third partial stream is then passed via line 303 to main heat exchanger 6 and from the cold end of the exchanger is passed to the engine-expansion machine 305, e.g., a turbine. Engine-expanded air 306 is then introduced at the middle section of the low-pressure column 9.

Downstream of each compressor 2, 5, 102, 302, the air is cooled by indirect heat exchange with cooling water. In the case of multistage compression, intermediate cooling is performed, preferably between two stages.

During rectification in high-pressure column 7, a first nitrogen-enriched top fraction accumulates as overhead gas, and a first oxygen-enriched fraction accumulates as bottom liquid. The overhead gas 10 is condensed in a first condenser-evaporator 11, and one portion 12, e.g., about 40 to 60% is introduced into the high-pressure column and the other portion 13—optionally after being subcooled in heat exchanger 14—is throttled 16 via line 15 into low-pressure column 9 operating at a pressure of 1.1 to 1.5 bar, preferably 1.2 to 1.4 bar. The other portion of condensed, nitrogen-enriched fraction 13 from the high-pressure column may be conveyed via optional line 17 to the top of medium-pressure column 8. The bottom liquid of the high-pressure column is throttled in valve 20, via lines 18 and 19, after optional subcooling (14), into low-pressure column 9 at a feed point above that of the engine-expanded air 306. Advantageously, a portion 37 (10 to 30%, preferably 15 to 20%) of the high-pressure column bottom liquid 18 is conveyed into the medium-pressure column at a feed point above the feed point of the second air partial stream 202 by at least one practical or theoretical plate, preferably by two to five theoretical plates.

In medium-pressure column 8, a second nitrogen-enriched top fraction and a second oxygen-enriched bottom liquid are obtained. Overhead gas 21 is condensed in a second condenser-evaporator 22, and a first portion 23 is throttled (25) into the medium-pressure column and a second portion 24—optionally after subcooling in heat exchanger 14—is throttled into low-pressure column 9. The bottom liquid of the medium-pressure column is depressurized in valve (27) via line 26, after optional subcooling (14) in the evaporation space of the second condenser-evaporator 22. The resultant evaporated stream 28 is introduced (29) into the low-pressure column 9 at a feed point, for example, at the same height as that of the feed of the bottom liquid from the high-pressure column, the latter being fed at a point preferably somewhat lower (not shown in the figures).

Vapor 31 for the rectification in low-pressure column 9 is produced by evaporation of bottom liquid 30 in a first condenser-evaporator 11 located, as shown in the figure, at the top of the high pressure column. Alternatively, the condenser-evaporator 11 can be arranged in the bottom of low-pressure column 9. As an overhead product, nitrogen 32 is withdrawn from low-pressure column 9, heated in heat exchangers 14 and 6 to about ambient temperature, and is drawn off at 33. The gaseous oxygen product 35 is removed via line 34 and is also heated in main heat exchanger 6. The oxygen product or a portion of it can, if desired, be removed in the liquid state (line 36). Conversely, the production of a high-pressure product, the oxygen that is removed in the liquid state can be pressurized and evaporated (internal compression).

The purification of the air feed is not depicted in the drawing. It can be carried out by any known method, for example, in a reversible heat exchanger (Revex) or in one or more molecular sieve systems. In the latter case, it is possible to subject the entire air feed (line 3) to purification, or to treat three partial streams 103, 201, 303 in separate systems, or else to send the first and second partial streams together through a molecular sieve that is arranged immediately downstream from the secondary condenser of compressor 5. If, unlike the embodiment in the drawing, the third partial stream is removed downstream one of compressors 5 or 102 and sent to secondary compressor 302, all three partial currents or at least the first and the third partial currents can be purified together.

In the embodiment, structured packing is used as the mass transfer elements in the high-pressure column and in the medium-pressure column. In principle, however, conventional distillation plates, random packing, and/or structured packing can be used in any of the columns. Combinations of different types of elements in a column are also possible. Because of the low pressure loss, structured packing is preferred in all columns, especially in the low-pressure column, thereby further enhancing the energy-saving of the invention.

The entire disclosure of all applications, patents and publications, cited above and below, and of corresponding German application 19537913.6, are hereby incorporated by reference.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

The following tables provide numerical examples for the process that is depicted in the drawing, Table 1 for the extraction of pure oxygen (99.5%) and Table 2 for the extraction of oxygen of medium purity (95.0%).

TABLE 1

GOX Purity: 99.5%
Total Power Consumption of the Compressor: 13,030 kW

| Drawing | Amount [mol/s] | Pressure [bar] | Temperature [K] | Fraction of Fluid in Vapor Phase x <= 1.0 | N2 content [mol %] | Ar content [mol %] | O2 content [mo %] |
|---|---|---|---|---|---|---|---|
| 1 | 2985.0 | 1.00 | 295.0 | 1.0 | 78.12 | 0.93 | 20.95 |
| 301 | 520.0 | 1.63 | 298.0 | 1.0 | 78.12 | 0.93 | 20.95 |
| 4 | 2465.0 | 1.63 | 298.0 | 1.0 | 78.12 | 0.93 | 20.95 |
| 303 | 520.0 | 1.74 | 298.0 | 1.0 | 78.12 | 0.93 | 20.95 |
| 304 | 520.0 | 1.64 | 98.1 | 1.0 | 78.12 | 0.93 | 20.95 |
| 306 | 520.0 | 1.21 | 90.9 | 1.0 | 78.12 | 0.93 | 20.95 |
| 101 | 2110.8 | 3.12 | 298.0 | 1.0 | 78.12 | 0.93 | 20.95 |
| 201 | 354.2 | 3.12 | 298.0 | 1.0 | 78.12 | 0.93 | 20.95 |
| 103 | 2110.8 | 4.84 | 298.0 | 1.0 | 78.12 | 0.93 | 20.95 |
| 104 | 2110.8 | 4.74 | 101.2 | 1.0 | 78.12 | 0.93 | 20.95 |
| 202 | 354.2 | 3.02 | 97.8 | 1.0 | 78.12 | 0.93 | 20.95 |
| 34 | 620.0 | 1.22 | 92.0 | 1.0 | 0.00 | 0.50 | 99.50 |
| 35 | 620.0 | 1.12 | 297.9 | 1.0 | 0.00 | 0.50 | 99.50 |
| 36 | 5.0 | 1.22 | 92.0 | 0.0 | 0.00 | 0.32 | 99.68 |
| 28 | 342.1 | 1.22 | 86.6 | 1.0 | 55.44 | 1.44 | 43.12 |
| 24 | 197.8 | 2.90 | 87.6 | 0.0 | 99.33 | 0.46 | 0.21 |
| before 25 | 197.8 | 2.90 | 87.6 | 0.0 | 99.33 | 0.46 | 0.21 |
| 26 | 342.1 | 3.02 | 92.2 | 0.0 | 55.44 | 1.44 | 43.12 |
| before | 342.1 | 3.02 | 92.2 | 0.0 | 55.44 | 1.44 | 43.12 |

TABLE 1-continued

GOX Purity: 99.5%
Total Power Consumption of the Compressor: 13,030 kW

| Drawing | Amount [mol/s] | Pressure [bar] | Temperature [K] | Fraction of Fluid in Vapor Phase x <= 1.0 | N2 content [mol %] | Ar content [mol %] | O2 content [mo %] |
|---|---|---|---|---|---|---|---|
| 27 | | | | | | | |
| 13 | 1063.1 | 4.63 | 93.0 | 0.0 | 99.46 | 0.45 | 0.09 |
| 17 | 10.7 | 4.53 | 89.2 | 0.0 | 99.46 | 0.45 | 0.09 |
| 15 | 1052.4 | 4.53 | 89.2 | 0.0 | 99.46 | 0.45 | 0.09 |
| 18 | 1047.7 | 4.74 | 97.8 | 0.0 | 56.46 | 1.42 | 42.12 |
| 37 | 175.0 | 4.64 | 81.1 | 0.0 | 56.46 | 1.42 | 42.12 |
| 19 | 872.7 | 4.64 | 81.1 | 0.0 | 56.46 | 1.42 | 42.12 |
| 32 | 2360.0 | 1.20 | 79.0 | 1.0 | 98.81 | 1.05 | 0.14 |
| 33 | 2360.0 | 1.00 | 297.8 | 1.0 | 98.81 | 1.05 | 0.14 |

TABLE 2

GOX Purity: 95.0%
Total Power Consumption of the Compressor: 10,018 kW

| Drawing | Amount [mol/s] | Pressure [bar] | Temperature [K] | Fraction of Fluid in Vapor Phase x <= 1.0 | N2 content [mol %] | Ar content [mol %] | O2 content [mol %] |
|---|---|---|---|---|---|---|---|
| 1 | 2850.0 | 1.00 | 295.0 | 1.0 | 78.12 | 0.93 | 20.95 |
| 301 | 953.2 | 1.49 | 298.0 | 1.0 | 78.12 | 0.93 | 20.95 |
| 4 | 1896.8 | 1.49 | 298.0 | 1.0 | 78.12 | 0.93 | 20.95 |
| 303 | 953.2 | 1.55 | 298.0 | 1.0 | 78.12 | 0.93 | 20.95 |
| 304 | 953.2 | 1.45 | 97.9 | 1.0 | 78.12 | 0.93 | 20.95 |
| 306 | 953.2 | 1.21 | 93.5 | 1.0 | 78.12 | 0.93 | 20.95 |
| 101 | 1294.6 | 3.11 | 298.0 | 1.0 | 78.12 | 0.93 | 20.95 |
| 201 | 602.2 | 3.11 | 298.0 | 1.0 | 78.12 | 0.93 | 20.95 |
| 103 | 1294.6 | 4.74 | 298.0 | 1.0 | 78.12 | 0.93 | 20.95 |
| 104 | 1294.6 | 4.64 | 98.6 | 1.0 | 78.12 | 0.93 | 20.95 |
| 202 | 602.2 | 3.01 | 97.3 | 1.0 | 78.12 | 0.93 | 20.95 |
| 34 | 620.0 | 1.22 | 91.8 | 1.0 | 2.55 | 2.45 | 95.00 |
| 35 | 620.0 | 1.12 | 297.9 | 1.0 | 2.55 | 2.45 | 95.00 |
| 36 | 5.0 | 1.22 | 91.8 | 0.0 | 0.67 | 1.62 | 97.71 |
| 28 | 575.6 | 1.22 | 86.6 | 1.0 | 55.64 | 1.44 | 42.92 |
| 24 | 320.9 | 2.89 | 87.6 | 0.0 | 99.18 | 0.46 | 0.36 |
| before 25 | 320.9 | 2.89 | 87.6 | 0.0 | 99.18 | 0.46 | 0.36 |
| 26 | 575.6 | 3.01 | 92.1 | 0.0 | 55.64 | 1.44 | 42.92 |
| before 27 | 575.6 | 3.01 | 92.1 | 0.0 | 55.64 | 1.44 | 42.92 |
| 13 | 652.0 | 4.52 | 92.8 | 0.0 | 99.24 | 0.46 | 0.30 |
| 17 | 3.1 | 4.42 | 81.0 | 0.0 | 99.24 | 0.46 | 0.30 |
| 15 | 648.9 | 4.42 | 81.0 | 0.0 | 99.24 | 0.46 | 0.30 |
| 18 | 642.6 | 4.64 | 97.5 | 0.0 | 56.69 | 1.41 | 41.90 |
| 37 | 291.2 | 4.54 | 80.1 | 0.0 | 56.69 | 1.41 | 41.90 |
| 19 | 351.4 | 4.54 | 80.1 | 0.0 | 56.69 | 1.41 | 41.90 |
| 32 | 2225.0 | 1.20 | 79.0 | 1.0 | 99.35 | 0.51 | 0.14 |
| 33 | 2225.0 | 1.00 | 297.8 | 1.0 | 99.35 | 0.51 | 0.14 |

The preceding examples can be repeated with similar success by substituting the generically or specifically described reactants and/or operating conditions of this invention for those used in the preceding examples.

The entire disclosure of all applications, patent and publications, cited above and below, and of corresponding German application 19537913.6, are hereby incorporated by reference.

From the foregoing description, one skilled in the art can easily ascertain the essential characteristics of the invention, and without departing from the spirit and scope thereof, can make various changes and modifications of the invention to adapt it to various usages and conditions.

What is claimed:

1. A process for the low-temperature separation of air in a triple-column system comprising a high-pressure column (7), a medium-pressure column (8) and a low-pressure column (9), comprising the following steps:

a) compression (2) of air feed (1) to a first pressure, resulting in a compressed air feed stream;

b) introduction of a first partial stream (101, 103, 104) of the compressed air feed (3) stream into the high-pressure column (7), after the first partial stream of the air feed is compressed (5, 102) from the first pressure to a second pressure which is at least equal to the pressure operating in the high-pressure column (7);

c) introduction of a second partial stream (201, 202) of the compressed air feed stream (3) into the medium-pressure column (8);

d) engine-expansion (305) of a third partial stream (301, 303, 304) of the resultant compressed air feed stream (3);

e) introduction of the resultant engine-expanded air feed (306) into the low-pressure column (9);

f) introduction (19) of at least part stream of a first oxygen-enriched bottom fraction (18) from the high-pressure column (7) into the low-pressure column (9);

g) condensation (11) of a first nitrogen-enriched top fraction (10) from high-pressure column (7) and introduction at least part of the resultant condensate (13, 15) into the low-pressure column (9) as reflux;

h) introduction (28) of at least part of a second oxygen-enriched bottom fraction (26) from the medium-pressure column (8) into the low-pressure column (9);

i) condensation (22) of a second nitrogen-enriched top fraction (21) from the medium-pressure column (8) and introduction (25) at least part of the resultant condensate (24) into the low-pressure column (9) as reflux, said process characterized in that j) the first pressure is lower than the operating pressure of the medium-pressure column (8), and k) the second partial stream of the air feed is compressed (5) from the first pressure to a third pressure which is at least equal to the operating pressure of the medium-pressure column (8), but lower than the second pressure.

2. A process according to claim 1, wherein the third partial stream (301) of the air feed is further compressed (302) upstream from the engine-expansion (305).

3. A process according to claim 2, wherein energy obtained during engine-expansion (305) of the third air partial stream (304) is used for further compression (302) of the third air partial stream (301).

4. A process according to claim 1, wherein the operating pressure at the top of the high-pressure column is not more than about 4.8 bar.

5. A process according to claim 1, wherein an overhead fraction (32, 33) is withdrawn from the low-pressure column (9), at substantially atmospheric pressure and is removed from the process and/or is used as regenerating gas.

6. A process according to claim 1, wherein a partial stream (37) of the first oxygen-enriched bottom fraction (18) from the high-pressure column (7) is introduced into the medium-pressure column (8).

7. A process according to claim 6, wherein the partial stream (37) of the first oxygen-enriched bottom fraction from the high-pressure column is introduced at an intermediate point into the medium-pressure column (8).

8. A process according to claim 5, wherein the top fraction is passed through at least one heat exchanger (14,6) prior to being removed from the process and/or used as a regenerating gas.

9. Apparatus for the low-temperature separation of air having a high-pressure column (7), a medium-pressure column (8) and a low-pressure column (9), comprising:

a) a main air compressor (2) for compressing air feed (1) to a first pressure, b) a first branched conduit (101, 103, 104), connected to the outlet of main air compressor (2) and to the high-pressure column (7), whereby the first branched conduit is in communication with means (5, 102) for compressing air feed from a first pressure to a second pressure which is at least equal to the operating pressure of the high-pressure column (7)

c) a second branched conduit (201, 202), connected to the outlet of main air compressor (2) and to the medium-pressure column (8), d) a third branched conduit (301,303, 304, 306), connected to the outlet of the main air compressor (2) and in communication with a engine-expansion machine (305) to low-pressure column (9), and e) conduit for introducing (13, 15, 16; 24, 25) liquid from the top of high-pressure column (7) and from the top of the medium-pressure column (8) into the low-pressure column (9), and for introducing (18, 19, 20; 26, 27, 28, 29) bottom liquid from the high-pressure column (7) and from the medium-pressure column (8) into the low-pressure column (9), said system characterized by f) means (5) for compressing air feed (4) from the first pressure to a third pressure, which is at least equal to the operating pressure of medium-pressure column (8), said means comprising an intake connected to the outlet of main air compressor (2) and an outlet connected to the second branched conduit line (201, 202).

10. Apparatus according to claim 8, further comprising a secondary compressor (302), arranged in the third branched conduit (301, 303) upstream from the engine-expansion machine (305).

11. Apparatus according to claim 10, further comprising means for transferring mechanical energy from the engine-expansion machine (305) to secondary compressor (302).

12. Apparatus according to claim 9, further comprising conduit (37) for introducing bottom liquid from the high-pressure column (7) into the medium-pressure column (8).

13. Apparatus according to claim 10, further comprising conduit (37) for introducing bottom liquid from the high-pressure column (7) into the medium-pressure column (8).

14. Apparatus according to claim 11, further comprising conduit (37) for introducing bottom liquid from the high-pressure column (7) into the medium-pressure column (8).

* * * * *